US007607180B2

(12) United States Patent
Griepentrog

(10) Patent No.: US 7,607,180 B2
(45) Date of Patent: Oct. 27, 2009

(54) CONVERTIBLE SEATING FURNITURE

(75) Inventor: Dennis G. Griepentrog, DePere, WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 11/674,779

(22) Filed: Feb. 14, 2007

(65) Prior Publication Data

US 2008/0189851 A1 Aug. 14, 2008

(51) Int. Cl.
*A47C 17/00* (2006.01)

(52) U.S. Cl. ..... 5/43; 5/47

(58) Field of Classification Search ..... 5/43, 5/53.1, 26.1, 12.1, 18.1, 47, 45, 37.1; 297/112, 297/125, 378.12

See application file for complete search history.

(56) References Cited

U.S. PATENT DOCUMENTS

| | | | |
|---|---|---|---|
| 120,270 | A | 10/1871 | Hall |
| 790,721 | A | 6/1905 | Owen |
| 791,720 | A | 6/1905 | Owen |
| 895,264 | A | 8/1908 | Harris et al. |
| 1,014,535 | A | 1/1912 | Sweeney |
| 1,228,604 | A | 6/1917 | Sandell |
| 1,637,493 | A | 8/1927 | Manott et al. |
| 2,534,175 | A | 12/1950 | Lorenz |
| 2,534,176 | A | 12/1950 | Lorenz |
| 2,634,429 | A | 4/1953 | Hopeman, Jr. et al. |
| 2,849,730 | A | 9/1958 | Polatsek |
| 3,258,787 | A | 7/1966 | Emmons et al. |
| 3,872,523 | A | 3/1975 | Garza |
| 4,106,137 | A | 8/1978 | Leclerc |
| 4,321,717 | A | 3/1982 | Serra |

*Primary Examiner*—Peter M. Cuomo
*Assistant Examiner*—William Kelleher
(74) *Attorney, Agent, or Firm*—Andrus, Sceales, Starke & Sawall, LLP

(57) ABSTRACT

A seating furniture assembly that is convertible from a first position to a second position has a seat member and a back member pivotably connected to the seat member. The back member is pivotable from a first position in which the back member extends upwardly from the seat member to form a seat, and a second position in which the back member overlies the seat member and faces upwardly to form a bed. Movement of the back member from the first position to the second position translates the seat member forwardly to provide wall clearance and a support in which the seat member supports a forward area of the back member when the back member is in the second position.

12 Claims, 8 Drawing Sheets

FIG. 1
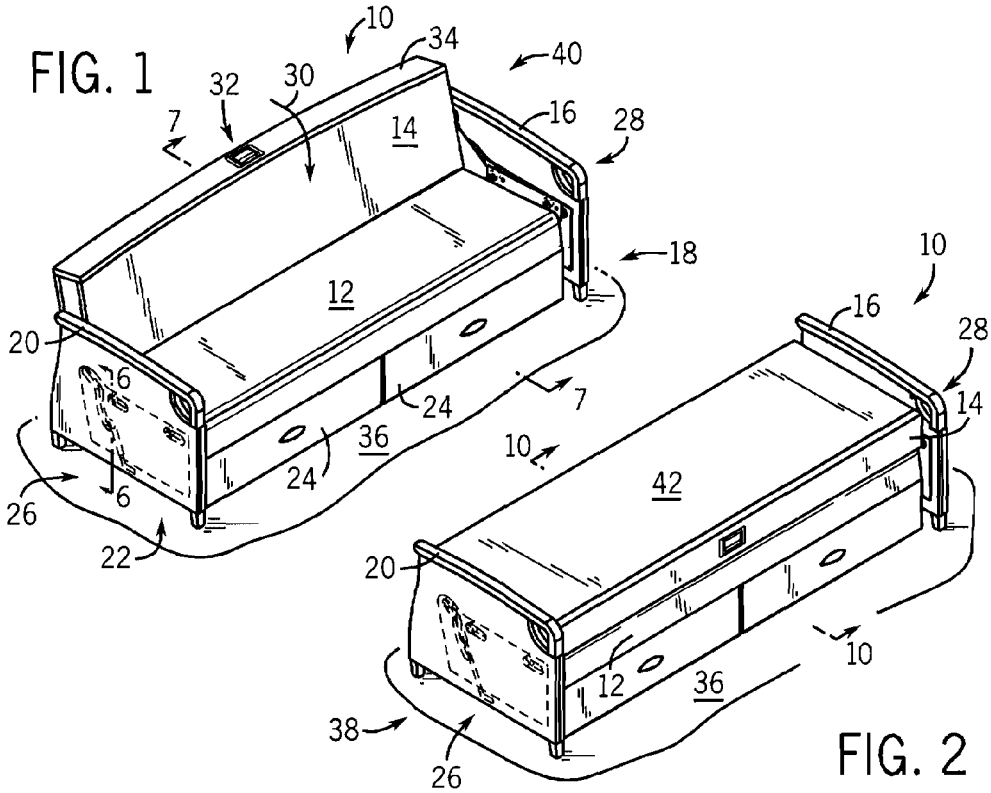
FIG. 2
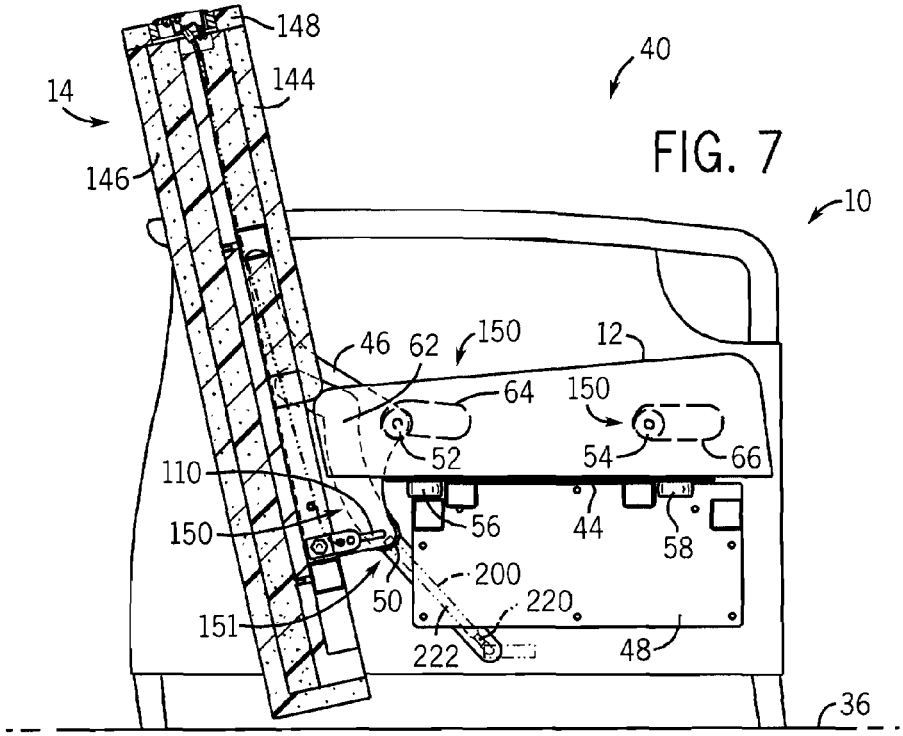
FIG. 7

FIG. 8
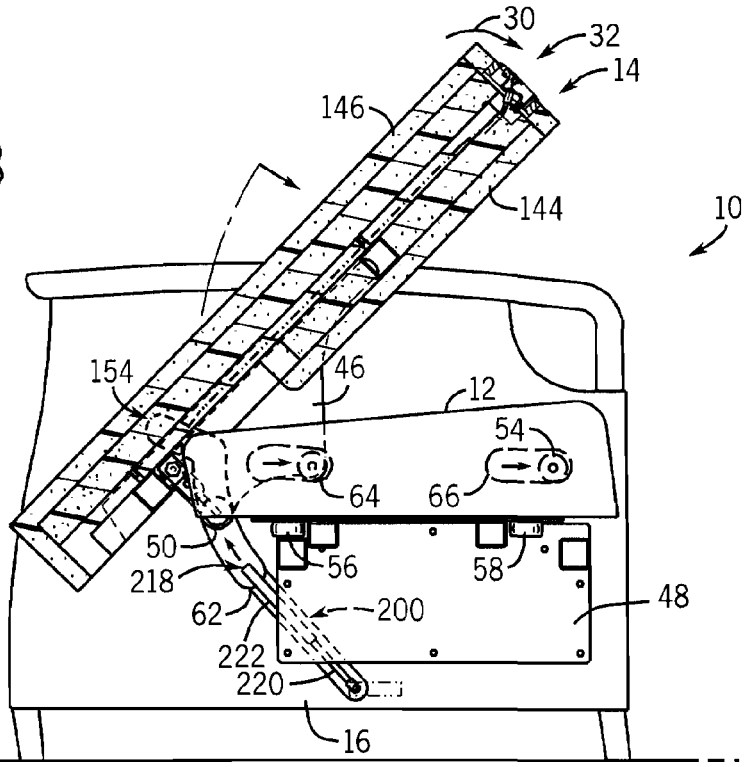
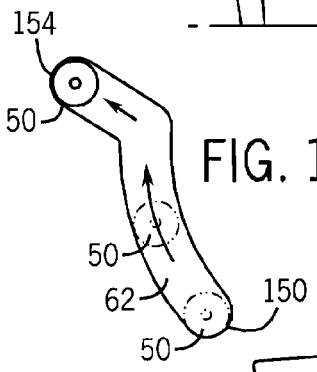
FIG. 10
FIG. 9
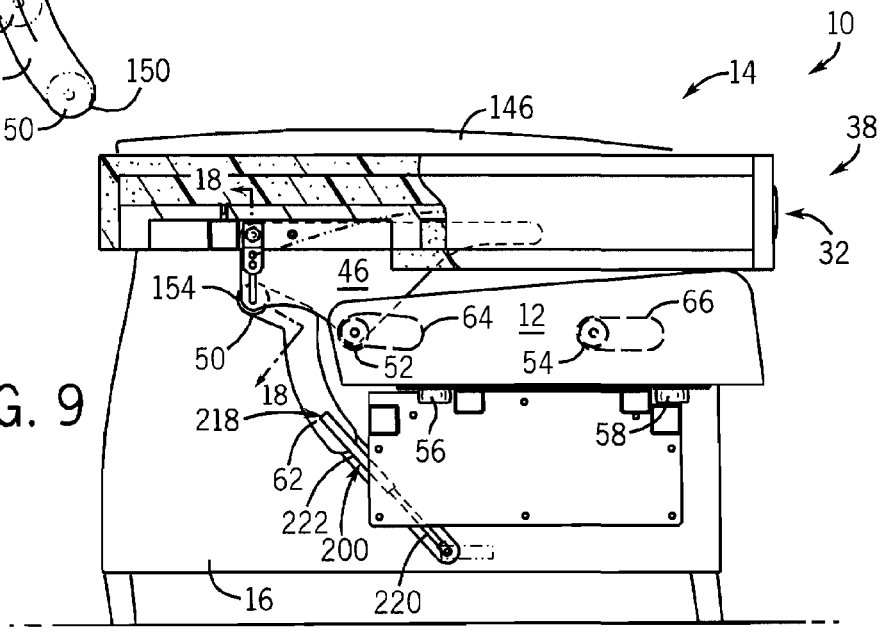

CONVERTIBLE SEATING FURNITURE

BACKGROUND OF THE INVENTION

1. Field of the Invention

The present invention relates generally to seating furniture and, more particularly, seating furniture that is convertible from a seating configuration to a sleeping configuration.

2. Discussion of the Related Art

Seating furniture such as chairs, recliners, loveseats and sofas are often constructed so as to be convertible from a seating configuration including a seat and a back oriented at an angle to each other, to a sleeping configuration in which the seat and the back are positioned relative to each other to provide an upwardly facing sleeping surface. Such prior art seating furniture provides a multi-functional capability, but often results in a relatively complicated construction and assembly. In addition, such prior art seating furniture also typically alters the room space required in order to convert the seating furniture from one configuration to another, in that a certain amount of space is required adjacent the seating furniture to allow movement of furniture elements from one configuration to another and to accommodate the components of the seating furniture when in the sleeping configuration.

Seating furniture that is convertible from a seating configuration to a sleeping or bed configuration often includes a bed that is disposed within or beneath the seat of the furniture assembly, or a bed surface which is formed from the combination of the seat and the back portion of the furniture assembly when in the sleeping or bed configuration. In the latter construction, the back surface is reclined relative to the seat surface so that both the back surface and the seat surface combine to provide an upwardly facing bed surface. Such assemblies require moving the furniture away from adjacent structures in the room and/or moving the furniture a substantial distance away from adjacent walls and/or furniture to obtain the space required in order to convert the furniture assembly to a sleeping or bed configuration.

Other multi-positional furniture assemblies allow the back portion of the furniture to rotate downwardly onto the seat portion of the furniture. Such furniture assemblies generally have a seat portion that is fixed relative to the back portion, and also require spacing of the furniture assembly from adjacent structures, such as walls or adjacent items of furniture. As the back portion is rotated onto the seat portion, an end of the back portion generally protrudes beyond a normal perimeter or footprint of the furniture assembly, typically defined by the seat portion and the frame, thereby requiring that the furniture be moved away from walls or adjacent furniture to convert the furniture assembly from the seating configuration to the sleeping configuration and vice versa. Furthermore, such furniture assemblies generally have relatively complex internal linkage assemblies which include a number of interconnected pivotable links that connect the seat portion and the back portion and allow the back portion to rotate relative to the seat portion. Such linkage assemblies increase the complexity, cost, assembly time and weight of the furniture assembly.

Therefore, it would be desirable to design a furniture assembly that is adjustable from a seating configuration to a sleeping or bed orientation. Additionally, it would be desirable to simplify the assembly and construction of the components that allow the furniture assembly to convert from a seat to a bed.

SUMMARY OF THE INVENTION

The present invention is directed to a seating furniture assembly that solves the aforementioned problems. The present invention provides a seating furniture assembly that is convertible from a first position to a second position. The furniture assembly has a seat member and a back member that is pivotable relative to the seat member. The back member is pivotable between a seating position in which the furniture assembly forms a seat, and a sleeping or bed position in which the furniture assembly forms an upwardly facing sleeping surface. Pivoting movement of the back member translates the seat member in the direction of rotation of the back member, thereby requiring a minimum of space adjacent the furniture assembly to convert the furniture assembly from a seating configuration to a bed configuration.

Therefore, in accordance with one aspect of the present invention, a seating furniture assembly is disclosed. The seating furniture assembly includes a seat member and a back member that is movable relative to the seat member, and which has a front surface and a back surface. The back member is movable between a first position for seating, and a second position for use in resting or sleeping. The seating furniture assembly includes a first pivot and a second pivot which are configured to allow translation and rotation between the seat member and the back member. When the back member is in the first position, the front surface of the back member extends upwardly from an upwardly facing surface of the seat member for supporting a user in a seated position. When the back member is in the second position, the back member overlies the seat member and the back surface of the back member is oriented generally horizontally so as to be parallel to a floor, for supporting a person in a sleeping or rest position.

According to another aspect of the invention, a variable configuration furniture assembly is disclosed. The furniture assembly includes a first end portion and a second end portion. A seat portion and a rotatable back portion are movably supported between the first end portion and the second end portion. The furniture assembly has a seating orientation in which a forwardly facing surface of the back portion extends upwardly from an upwardly facing support surface of the seat portion, and a prone orientation in which the back portion overlies the seat portion and an upwardly facing surface of the back portion is oriented generally horizontally. When the furniture assembly is in the prone orientation, the back portion may be oriented generally parallel to the seat portion. The back portion and the seat portion are engaged with the first and second end portions such that movement of the furniture assembly from the seating orientation to the prone orientation translates the seat portion laterally relative to the back portion.

In accordance with a further aspect of the present invention, a method of converting an article of furniture between a seat configuration and a bed configuration is disclosed. The method includes the steps of providing an article of furniture having a seat back and a seat member in a seating configuration, and rotating the seat back toward the seat member to expose a rear area of the seat back to form an upwardly facing bed surface. The method may also include translating the seat member forwardly as the seat back is rotated toward the seat member, to a support position in which the seat member supports a forward area of the seat back.

Various other features, objects and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings:

FIG. 1 is a perspective view of a seating furniture assembly according to the present invention, showing the seating furniture assembly in a seating configuration.

FIG. 2 is a perspective view similar to FIG. 1, showing the seating furniture assembly converted to a sleeping or bed configuration.

FIG. 7 is a cross-sectional elevational view of the seating furniture assembly taken along line 7-7 of FIG. 1.

FIG. 8 is a view similar to FIG. 7 showing the back portion of the seating furniture assembly partially rotated relative to the seat portion.

FIG. 9 is a view similar to FIGS. 7 and 8 showing the back portion of the seating furniture assembly fully rotated relative to the seat portion to the bed configuration as in FIG. 2, and taken along line 10-10 of FIG. 2.

FIG. 10 is an elevational view showing multiple positions of a cam incorporated in the positioning assembly of FIG. 5 when engaged with the arm section as shown in FIG. 3, during movement of the back portion from the seating configuration of FIG. 1 to the bed configuration of FIG. 2.

DETAILED DESCRIPTION OF PREFERRED EMBODIMENTS

Figure 3:
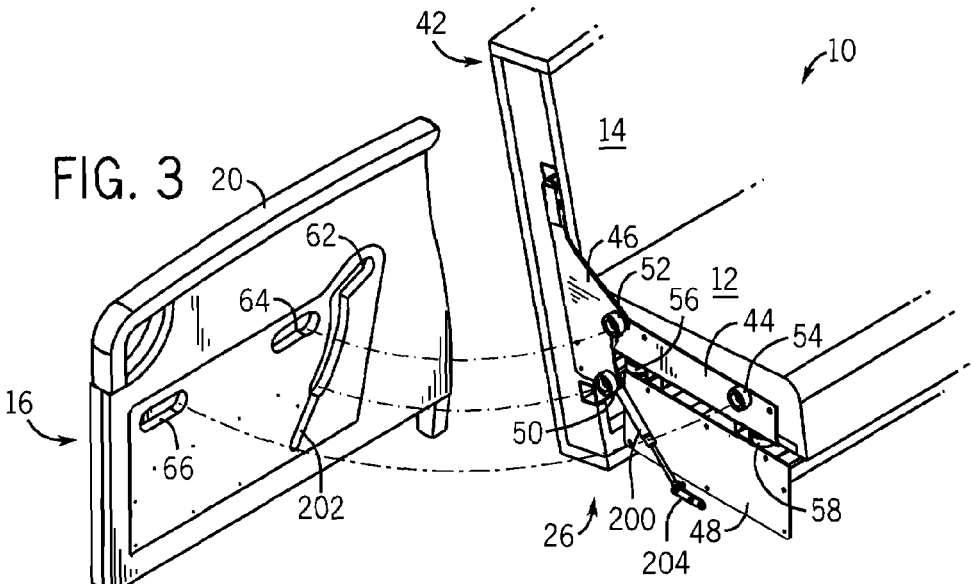
FIG. 3 is an exploded partial perspective view of an end of the seating furniture assembly shown in FIG. 1.

FIG. 1 shows a seating furniture assembly 10 according to the present invention. Seating furniture assembly 10 includes a seat member or seat portion 12 and a movable back member or back portion 14 that is normally positioned to extend upwardly from seat portion 12 such that seating furniture assembly 10 is in a seat forming configuration. A first arm member 16 is positioned at a first end 18 of furniture assembly 10 and a second arm member 20 is positioned at a second end 22 of furniture assembly 10 generally opposite first end 18. An optional storage assembly 24 is connected to seating furniture assembly 10 and located generally below seat portion 12. Seating furniture assembly 10 includes positioning assemblies 26, 28 that are generally disposed at ends 18, 22 of furniture assembly 10, respectively. Seat portion 12 and back portion 14 of seating furniture assembly 10 are connected via positioning assemblies 26, 28 such that back portion 14 is rotatable, indicated by arrow 30, relative to seat portion 12. Back portion 14 includes a latch assembly or latch mechanism 32 having an actuator generally located at an upper portion 34 of back portion 14 such that back portion 14 is securable relative to seat portion 12 and a user can easily manipulate the position of back portion 14 from a floor surface 36 generally in front of furniture assembly 10.

Referring to FIG. 2, back portion 14 is movable such that furniture assembly 10 defines an upwardly facing support surface when the furniture assembly is configured in a bed configuration 38, as shown in FIG. 2. Comparing FIG. 1 and FIG. 2, it can be seen that back portion 14 is rotatable between the seat forming configuration, shown at 40 in FIG. 1, and the bed forming orientation 38 shown in FIG. 2. When furniture assembly 10 is positioned in bed orientation 38, the rear surface of back portion 14 forms a bed surface 42 of seating furniture assembly 10. Bed surface 42 is generally parallel to seat portion 12 and offset therefrom when furniture assembly 10 is positioned in bed configuration 38. It is understood that the configuration of bed surface 42 could have any desired contour, and that the contour shown allows a user of bed surface 42 to achieve a completely prone position. It is also understood that bed surface 42 may have a reclined or angled contour if desired, such that a user's torso and/or lower legs may be raised or lowered with respect to the user's upper body. Seating furniture assembly 10 generally defines a perimeter or footprint formed by back portion 14 in combination with first arm member 16 and second arm member 20 when furniture assembly 10 is positioned in bed configuration 38. This construction ensures that a user can easily get onto and off of bed surface 42. Once furniture assembly 10 is positioned in bed configuration 38, positioning assemblies 26, 28 and latch mechanism 32 maintain the orientation of furniture assembly 10 to prevent inadvertent conversion of the furniture assembly between seat configuration 40 of FIG. 1 and bed configuration 38 of FIG. 2.

FIG. 3 shows arm member 20 removed from furniture assembly 10, exposing positioning assembly 26. Positioning assembly 26 includes a movable seat bracket, or first bracket 44 secured to seat portion 12 and a back bracket, or second bracket 46 pivotably connected to seat bracket 44 and attached to back portion 14. Each of a pair of seat supports 48 generally extend the length of seat portion 12 and are secured to arm members 16, 20 at respective ends thereof to form a rigid frame for the movable seat portion 12 and back portion 14.

Figure 5:
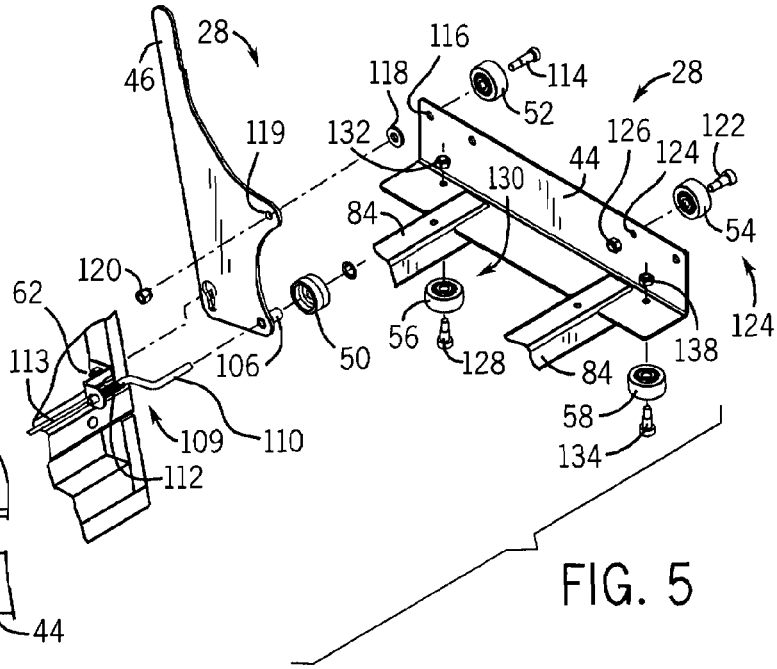
FIG. 5 is a partial exploded perspective view of a positioning assembly incorporated in the seating furniture assembly shown in FIG. 1.
Figure 4:
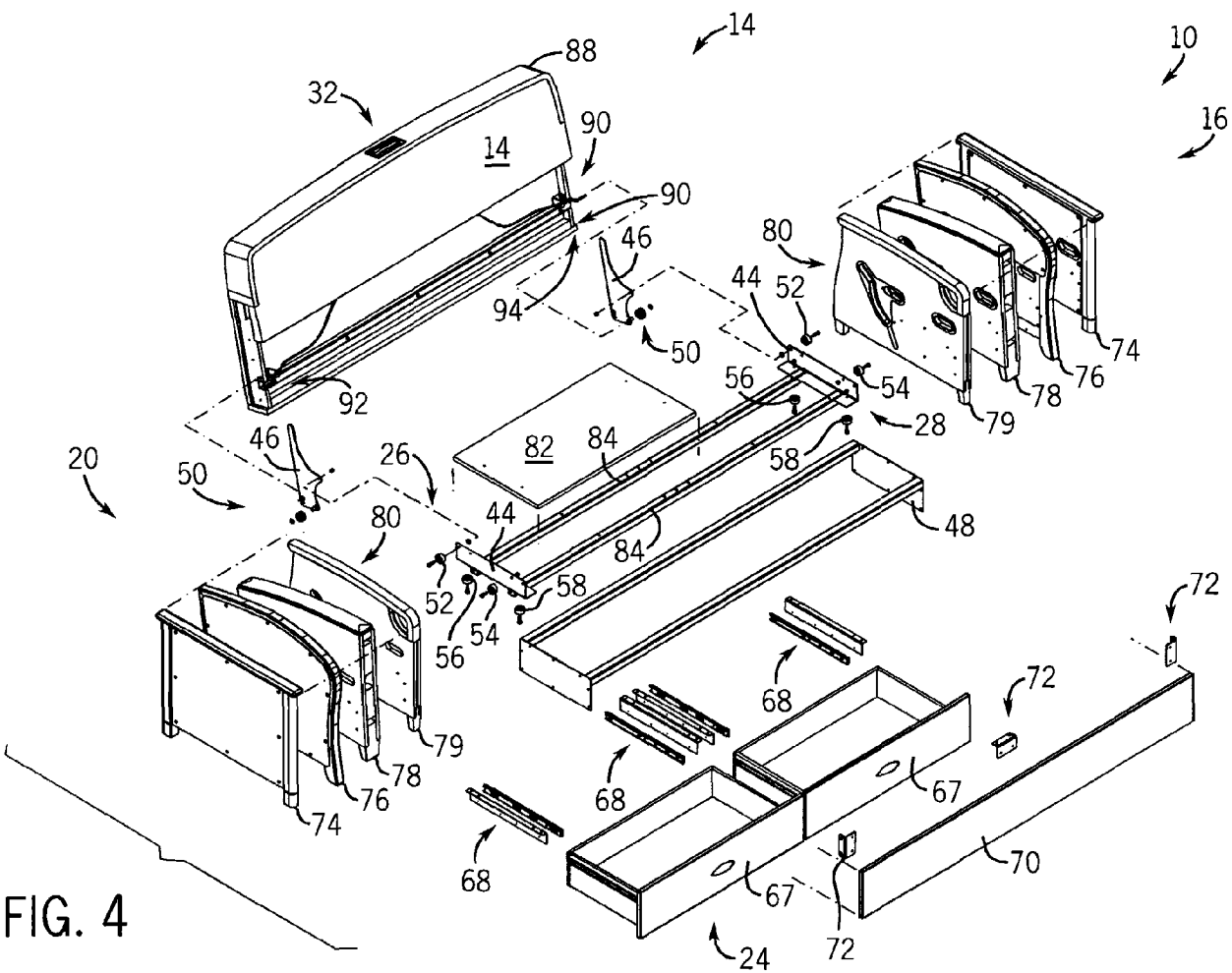
FIG. 4 is an exploded perspective view of the seating furniture assembly shown in FIG. 1.

Positioning assemblies 26 and 28 have a mirror image construction, as do arm members 16 and 20. In each case, like reference characters will be used for the components of arm members 16, 20 and positioning assemblies 26, 28 to facilitate clarity. As shown in FIGS. 3-5, positioning assemblies 26, 28 include a number of rotatable rollers 50, 52, 54, 56, 58 that allow the relatively smooth movement of seat portion 12 and back portion 14 relative to arm members 16 and 20. Arm member 20 includes a series of channels 62, 64, 66 formed therein. When arm member 20 is connected to furniture assembly 10, channel 62 receives roller 50, channel 64 receives roller 52 and channel 66 receives roller 54. During movement of back portion 14 relative to arm member 20, rollers 50, 52 and 54 function as cam followers that move or translate within channels 62, 64, 66, respectively, as will be described further with respect to FIGS. 7-10.

As shown in FIG. 3, furniture assembly 10 includes a spring member 200 that is operationally connected between seat bracket 44 and arm member 20. A cavity 202 is formed in arm member 20 and constructed to receive spring member 200. A retention plate 204 is connected to one end of spring member 200 and secured to arm portion 20. The construction and operation of spring member 200 is described further with respect to FIGS. 7-10.

As shown in FIG. 4, seating furniture assembly 10 includes a number of interconnected components. Optional storage assembly 24 can include one or more movable drawers, and preferably includes a pair of drawers 67. The storage assembly 24 includes a pair of drawer slide assemblies 68 associated with each drawer 67. Alternatively, an optional kick plate member 70 may be mounted to the front of seating assembly 10 using a number of mounting brackets 72 constructed to secure kick plate member 70 to seating furniture assembly 10 between arms 16, 20. First arm member 16 and second arm member 20 may be provided in a series of different styles 74, 76, 78, 79, each of which includes a substantially similar guide assembly or guide arrangement 80 that includes channels 62, 64 and 66. Guide assemblies 80 are configured to operatively engage rollers 50, 52, 54 of positioning assemblies 26, 28. Seat supports 48 are constructed to engage each of arm members 16, 20 and to slidably support seat bracket 44 of positioning assemblies 26, 28.

A seat base 82 is attached to a pair of seat base supports 84 and configured to receive a seat cushion thereon. Seat base supports 84 and seat brackets 44 are constructed to translate relative to arm members 16 and 20 via rollers 52, 54, which engage guide assemblies 80 of arm members 16, 20, respectively. Back brackets 46 are pivotably connected to seat brackets 44 and constructed to engage back portion 14. Back portion 14 includes a frame 88, a pair of supports 90 extending generally across frame 88 to generally opposite ends 92, 94, and latch mechanism 32.

FIG. 5 shows positioning assembly 28 removed from furniture assembly 10. The positioning assembly 28 shown in FIG. 5 is from an end of the furniture assembly generally opposite the positioning assembly 26 shown in FIG. 3 and, as noted, the positioning assemblies 26 and 28 are generally mirror images of one another. It is further understood that the following description of positioning assemblies 26, 28 include exemplary embodiments of a preferred pivot assembly. One of ordinary skill in the art will appreciate that the embodiment disclosed herein is exemplary and other pivot arrangements such as a simple pin and groove or hole are envisioned and within the scope of the claims.

Referring to FIG. 5, positioning assembly 28 includes rotatable rollers 50, 52, 54, that are engaged within the channels of guide arrangement 80 of arm member 16 and act as followers in order to guide movement of back portion 14 between the upstanding position and the lowered position. Roller 50 is rotatably mounted to a pivot axle or pin 106, which has a tubular construction, and which is carried by back bracket 46.

Figure 11:
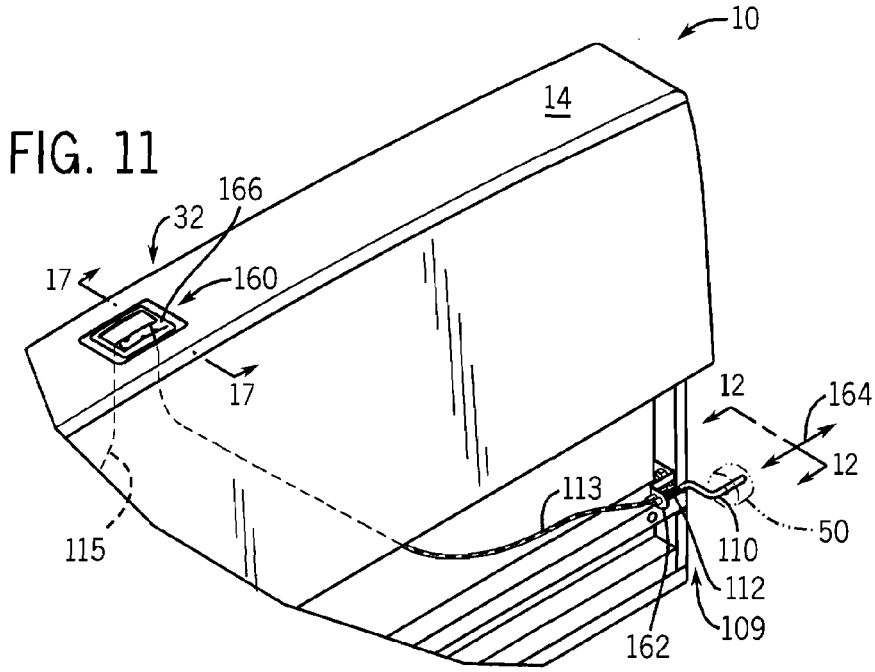
FIG. 11 is a partial perspective view of the seating furniture shown in FIG. 1 with the seat portion removed therefrom, and exposing a portion of a latch mechanism incorporated in the seating furniture assembly.

Latch mechanism 32 includes a latch assembly 109 having a latch pin 110 constructed to extend through the tubular pivot pin 106 and secure the position of back bracket 46 relative to arm member 16, and to thereby secure the position of back portion 14 relative to seat portion 12. In a preferred embodiment, latch mechanism 32 includes a latch assembly associated with each of the generally opposite arms 16, 20 of the furniture assembly as discussed below with respect FIG. 11. A spring 112 biases latch pin 110 into engagement with pivot pin 106. An actuator cable 113 is connected to each of the respective arm section latch pins 110 and extends to an actuator handle assembly as is also discussed below with respect to FIG. 11.

An axle or pivot pin 114 extends through roller 52 in order to rotatably mount roller 52 to seat bracket 44, and extends through an opening 116 in seat bracket 44, and through an aligned washer 118. Pivot pin 114 also extends through an opening 119 formed in an ear defined by back bracket 46, and engages a nut 120. In this manner, pivot pin 114 functions to pivotably secure seat bracket 44 and back bracket 46 for movement about a pivot axis defined by the longitudinal axis of pivot pin 114. A pivot pin 122 extends through roller 54, and through an opening 124 formed in seat bracket 44 for engagement with a nut 126.

Each of rollers 56 and 58 has an axis of rotation that is generally transverse to the axes of rotation of the rollers 50, 52 and 54. An axle or pin 128 passes through roller 56, through an opening in seat bracket 44, and engages nut 132. Likewise, an axle or pin 134 passes through roller 58, through an opening in seat bracket 44, and engages a nut 138. Accordingly, rollers 56 and 58 are rotatably secured to seat bracket 44 such that rollers 56, 58 are movable along with seat bracket 44 relative to arm member 16.

Figure 6:
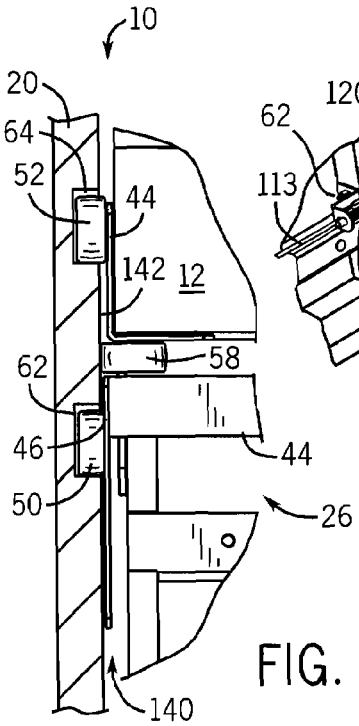
FIG. 6 is a partial cross-sectional view of a portion of the positioning assembly shown in FIG. 5 and taken along line 6-6 of FIG. 1.

FIG. 6 shows the engagement of positioning assembly 26 with arm member 20. Roller 50 engages channel 62 and allows rotation of back bracket 46 about the pivot axis defined by pivot pin 114, to which roller 52 is rotatably mounted. Roller 52 is engaged within channel 64, and thus allows back bracket 46 to rotate and translate relative to arm member 20 upon rotation of the back portion 14 of the furniture assembly 10. Similarly, roller 54 is engaged within channel 66, and accommodates translation of seat portion 12 relative to arm members 16, 20 upon rotation of the back portion 14. Roller 50 and groove or channel 62 cooperates in a cam and follower manner to guide the back portion 14 of furniture assembly 10 through its range of motion. Rollers 56 and 58, being oriented generally transverse to rollers 50, 52 and 54, maintains an operational spacing 140 between seat bracket 44, seat portion 12, and an inner surface 142 of arm member 20. In this manner, seat portion 12 translates smoothly between the arm members 16, 20 during movement of the back portion 14 of furniture assembly 10 between the seating orientation and the bed orientation. Such a construction ensures trouble free operation of the furniture assembly 10 by maintaining the alignment of the seat portion 12 and the arm members 16, 20 through the range of translation of seat member 12.

As shown in FIGS. 7-10, back portion 14 includes a number of padded surfaces 144, 146, 148 generally positioned about the back portion 14. In the seating orientation 40 shown in FIG. 7, a user typically sits upon seat portion 12 and leans back against back portion 14. The components of seating furniture assembly 10 cooperate to provide a stable and comfortable seating configuration. When furniture assembly 10 is in the seating configuration 40, roller 50 is engaged with an end 150 defined by channel 62, which thus positively positions back portion 14 in a desired angular orientation relative to seat portion 12. Roller 52, having back bracket 46 connected thereto, allows rotation of back bracket 46 relative to seat bracket 44. Roller 50, which is connected to back bracket 46, translates along channel 62 in the cam and follower association as back portion 14 is lowered. As shown in FIG. 7, rollers 52, 54 are engaged with the rearward ends of channels 64, 66, respectively, when furniture assembly 10 is in the seating configuration in which back portion 14 extends upwardly from seat portion 12.

Figure 7A:
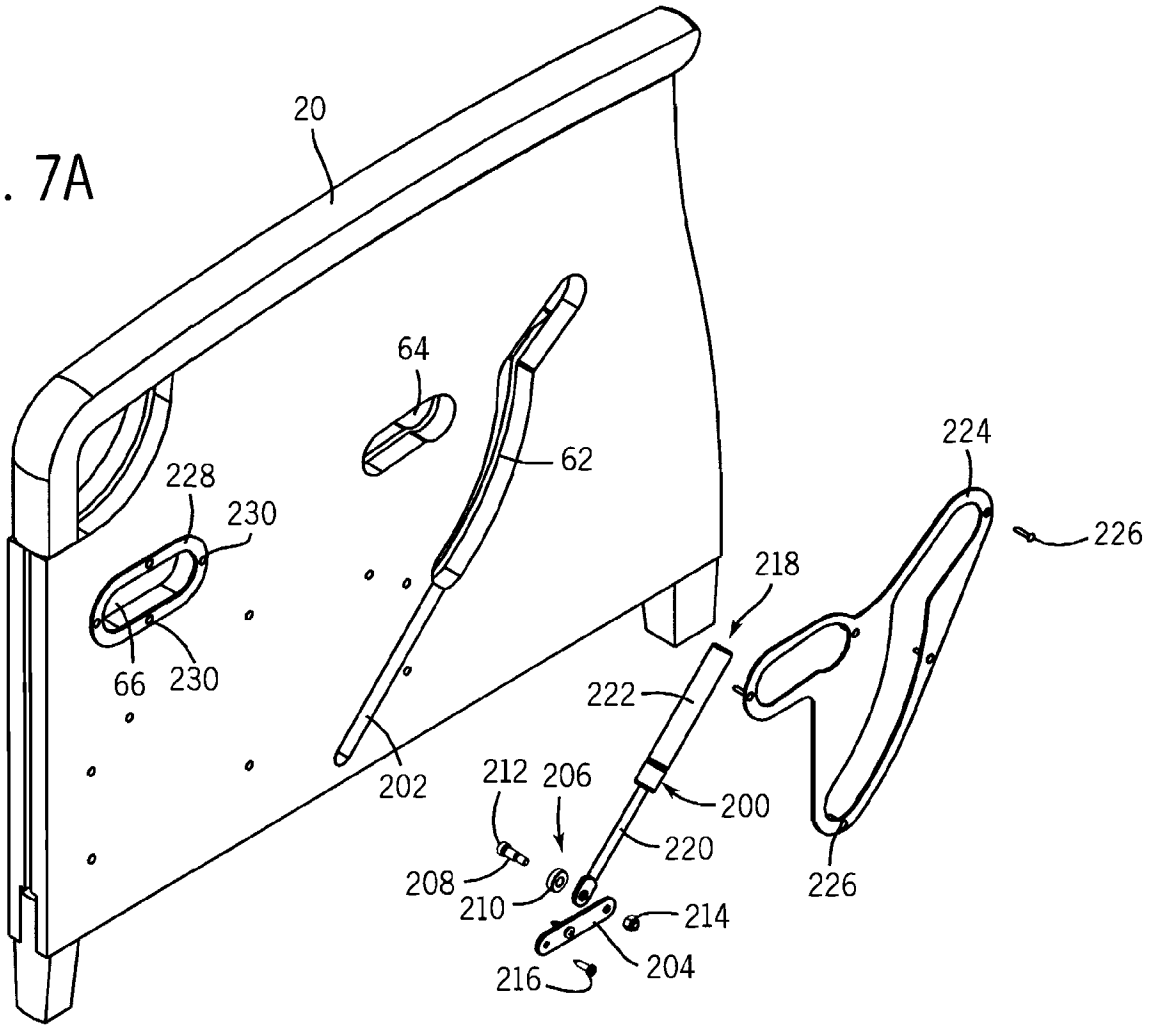
FIG. 7A is a partial exploded isometric view showing an inside surface of an end member, and certain components interconnected therewith, incorporated in the seating furniture assembly of FIG. 1.

Referring to FIG. 7*a*, cavity 202 is formed in arm member 20 and is generally aligned with channel 62 formed in the arm member 20. Cavity 202 and channel 62 are constructed to allow spring member 200 to extend and retract therein. A first end 206 of spring member 200 is rotationally connected to retention plate 204 by a pivot pin 208. A washer 210 is disposed between first end 206 of spring member 200 and a head portion 212 of pivot pin 208. A nut 214 engages an end of pivot pin 208 generally opposite head portion 212 to secure first end 206 of spring member 200 to retention plate 204. A fastener 216 passes through retention plate 204 and secures the retention plate 204 to arm member 20. Understandably, a second spring member could be provided at the opposite end of furniture assembly 10 if desired.

A second end 218 of spring member 200 extends into the lower area of channel 62, and is arranged to engage roller 50 as roller moves within the lower area of channel 62. In this manner, second end 218 of spring member 200 moves with the back bracket 46 and pushes against roller 50 over a portion of the range of movement of back bracket 46. Specifically, second end 218 of spring member 200 engages roller 50 and retracts in order to cushion the movement of back portion 14 as back portion 14 is being moved toward the upright position during conversion of furniture assembly 10 from the bed configuration to the seating configuration. Spring member 200 then remains in the retracted position as furniture assembly remains in the seating configuration. When it is desired to move furniture assembly 10 from the seating configuration to the bed configuration, spring member 200 applies a biasing force on roller 50 to move roller 50 upwardly within the lower area of channel 62, to provide an assist in rotating back portion 14 away from the upright position and toward the seat portion 12. It is appreciated the spring member 200 is shown as a gas cylinder that includes a ram 220 that extends and retracts relative to a cylinder 222. Understandably, spring member 200 could be provided as other movement controlling means such as helical springs or the like. It is further appreciated that spring member 200 could be constructed to provide a variable resistance force that assists in the movement in the back member 14. That is, spring member 200 is constructed to assist in the raising of the back member 14 and partially resist the gravitational lowering of back member 14. Such a construction allows smooth translation of back member 14 from the bed configuration to the seat configuration with minimal user effort. The operation of spring member 200 is described further below with respect to FIGS. 8 and 9.

Also shown in FIG. 7A, furniture assembly 10 includes a trim plate 224 constructed to generally align with channels 62, 64. A number of fasteners 226 pass through trim plate 224 and secure the trim plate 224 about channels 62, 64. Another trim plate 228 is secured about channel 66 with a number of fasteners 230 as well. Trim plates 224, 228 allow fabric that covers arm portion 20 to be cleanly removed from over channels 62, 64, 66.

Referring to FIG. 8, upon rotation of back portion 14 in the direction of arrow 30 relative to seat portion 12, rollers 52 and 54 translate forwardly in channels 64, 66 as the lower end of back portion 14 is raised, due to the configuration of channel 62 and the offset relationship between the axes of rollers 50, 52 and 54. Such engagement of rollers 52, 54 with the forward ends of channels 64, 66, respectively, functions to push seat portion 12 forwardly from the rear position of channels 64 and 66, so that the forward area of seat portion 12 underlies the end area of back portion 14 as back portion 14 is moved toward seat portion 12. As back portion 14 is further moved toward its lowered position as shown in FIG. 9, roller 50 is moved from a generally arcuate area of channel 62 into a generally linear upwardly angled upper end area of channel 62. This functions to relieve the forward pushing force on seat portion 12 applied by engagement of rollers 52, 54 with the forward ends of channels 64, 66, respectively, and functions to draw rollers 52 and 54 rearwardly in channels 64, 66 as roller 50 is moved upwardly and rearwardly in the linear upper end area of the channel 62 as back portion 14 is moved toward its fully lowered position, to provide a compound motion connection between seat portion 12 and back portion 14. When seat portion 12 is fully lowered, roller 50 is moved into an end area of channel 62 and into engagement with an upper end 154 of channel 62.

As shown in FIG. 9, rotation of back portion 14 relative to seat portion 12 translates roller 50 in channel 62 from a lower position adjacent lower end 150 when furniture assembly 10 is in the seating configuration to an upper position adjacent upper end 154 when furniture assembly 10 is in the bed configuration.

As shown in FIG. 9, back portion 14 is rotatable to the bed configuration in which bed surface 146 is oriented generally parallel to seat portion 12. When back portion 14 is in the bed configuration, it is supported in cantilever fashion by rollers 50 and 52 in channels 62 and 62, respectively, and somewhat by the front area of seat portion 12. Rollers 56 and 58 also translate relative to arm members 16, 20 and allow for smooth operation of the rotation and translation of rollers 50, 52 and 54. Accordingly, furniture assembly 10 can be quickly and easily converted from a seat-forming configuration to a bed-forming configuration.

Referring to FIGS. 7-9, and as noted previously, translation of back portion 14 from the seat configuration, shown in FIG. 7, toward the bed configuration, shown in FIG. 9, results in the end 218 of spring member 200 pushing on roller 50 by extension of ram 220 from cylinder 222 as back portion 14 rotates toward seat portion 12. When back portion 14 is moved from the seat configuration toward the bed configuration, spring member 200 pushes on roller 50 to assist in rotation of back portion 14 past the vertical position. Similarly, when back portion 14 is moved from the bed configuration toward the seat configuration, roller 50 engages end 218 of spring member 200 when back portion 14 is rotated past the vertical position, and pushes on roller 50 to provide a soft brake for back portion 14 as it is moved toward the seat configuration.

Figure 12:
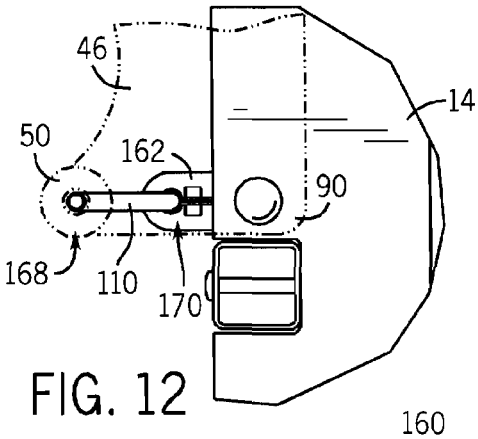
FIG. 12 is an end elevational view of a portion of the latch mechanism with reference to line 12-12 of FIG. 11.

Referring to FIGS. 11-17, latch mechanism 32 includes an actuator handle assembly 160 which is operatively connected to latch assembly 109 via a pair actuator cables 113, 115. Each cable 113, 115 extends to a latch assembly 109 constructed to engage each of arms 16, 20, respectively. It is appreciated that the latch assemblies 109 located at opposite ends 18, 22 of furniture assembly 10 have generally mirror image constructions. A latch bracket 162 secures latch pin 110 to back portion 14 so as to allow translation of latch pin 110 in direction 164 via actuation of a handle 166 of actuator handle assembly 160. As shown in FIG. 12, latch pin 110 includes an outer or distal end 168 constructed to pass through roller 50 and back bracket 46. Latch bracket 162 is secured to support 90 of back portion 14 and includes an opening 176 constructed to slidably support latch pin 110.

Figure 13:
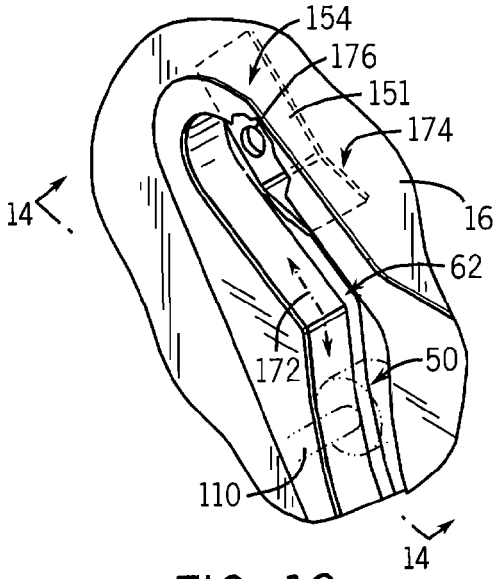
FIG. 13 is a partial perspective view showing one embodiment of a cam track incorporated in an arm section of the seating furniture assembly shown in FIG. 1.
Figure 14:
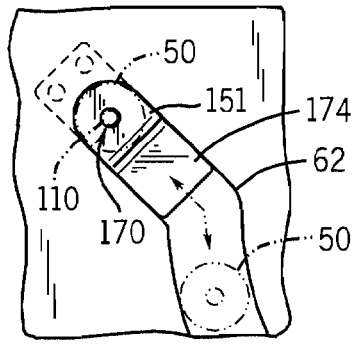
FIG. 14 is an elevational view showing the cam track of FIG. 13 and movement of a cam follower associated with the positioning assembly within the cam track.

As shown in FIGS. 13 and 14, roller 50 is slidably received within channel 62 of arm member 16. Roller 50 translates in channel 62 along directions indicated by arrow 172. Latch pin 110 translates with roller 50 during rotation of back portion 14. A latch plate 151 is positioned adjacent upper end 154 of channel 62 and is constructed to operatively engage the outer or distal end of latch pin 110. Latch plate 151 includes a ramped guide portion 174 constructed to deflect latch pin 110 as roller 50 moves upwardly in the linear angled portion of channel 62 and approaches upper end 154. Opening 176 of latch plate 151 slidably receives the distal end of latch pin 110 and secures roller 50 at upper end 154 of channel 62 when back portion 14 is positioned in the bed orientation. Providing latch assemblies at generally opposite ends 18, 22 of furniture assembly 10 provides a securing means that can withstand repeated and uneven loading of the furniture assembly. That is, securing back portion 14 at generally opposite ends of the furniture assembly 10 when back portion 14 is oriented in bed configuration 38 provides a robust convertible furniture assembly that is not susceptible to unintentional translation of back portion 14.

Figure 15:
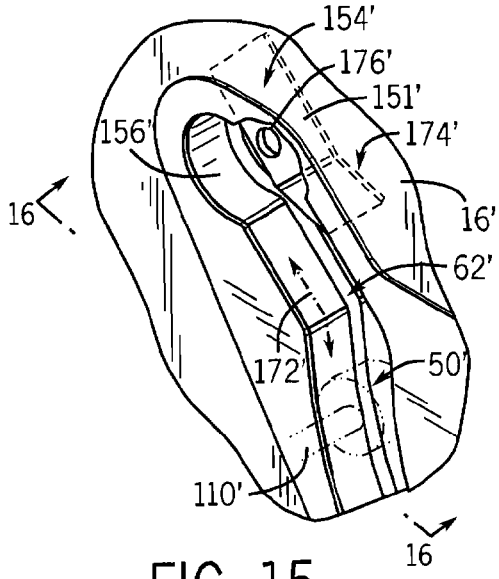
FIG. 15 is a view similar to FIG. 13 showing an alternate embodiment of the cam track shown in FIG. 13.
Figure 16:
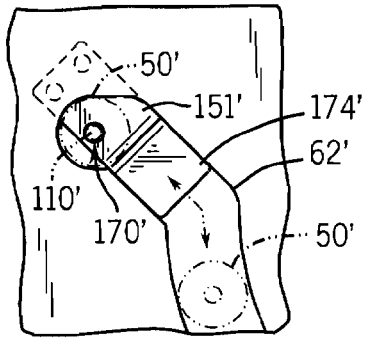
FIG. 16 is an elevational view similar to FIG. 14 showing the cam track of FIG. 15 and movement of the cam follower associated with the positioning assembly within the alternate cam track.

FIGS. 15 and 16 show an alternate embodiment of the construction of furniture assembly 10. As shown therein, a channel 62' is formed in arm portion 16'. Roller 50' is operatively associated with channel 62' somewhat similar to the engagement of roller 50 with channel 62 as shown in FIGS. 13 and 14. Comparatively, channel 62' includes a generally flat land 156' constructed to engage roller 50'. The orientation of land 156' relative to a vertical axis of furniture assembly 10, allows roller 50' to be retained at the upper end of channel 62'. When roller 50' is positioned in land 156' of channel 62', downward pressure upon bed surface 146' will not translate roller 50' relative to channel 62'.

Figure 17:
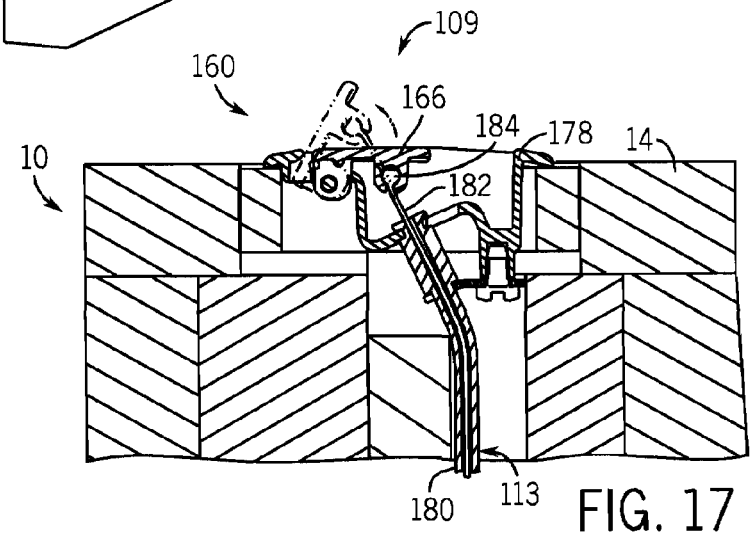
FIG. 17 is a cross-sectional view showing a handle portion of a latch mechanism incorporated in the seating furniture assembly taken along the line 17-17 of FIG. 11.
Figure 18:
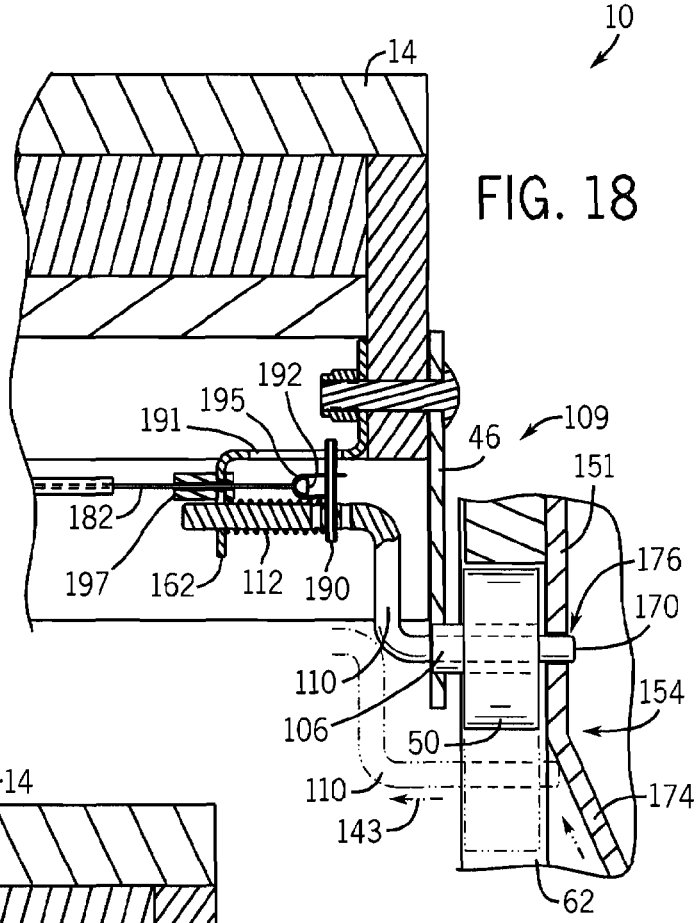
FIG. 18 is a section view taken along line 18-18 of FIG. 9, showing a latch assembly of the latch mechanism in a locked position.
Figure 19:
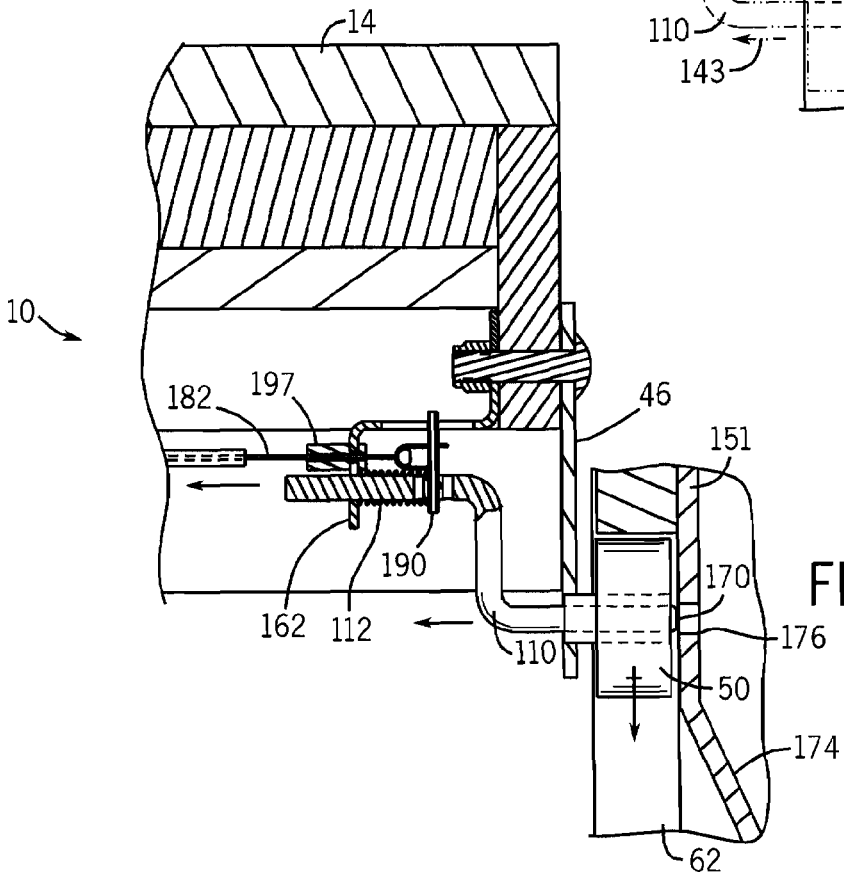
FIG. 19 is a view similar to FIG. 18, showing the latch mechanism in an unlocked position.

As shown in FIG. 17, actuator handle assembly 160 of latch assembly 109 includes a housing 178 secured to back portion 14 of seating furniture assembly 10. Handle 166 is pivotably secured to housing 178 via a handle pivot pin 179 that is secured to housing 178 and extends in a direction generally parallel to a longitudinal axis defined by back portion 14. The construction and operation of actuator handle assembly 160 is shown and described in detail in copending application Ser. No. 11/335,359 filed Feb. 16, 2006, the disclosure of which is hereby incorporated by reference. Cable 113 extends through back portion 14 and includes a sheath 180 and a cable 182 passing through the sheath 180. A fitting 184 is attached to a terminal end of cable 182 and is secured within a recess defined by handle 166. Handle 166 is pivotable between an engaged position as shown in solid lines in FIG. 17 and a release position as shown in phantom in FIG. 17, which functions to selectively translate cable 182 relative to sheath 180. Referring to FIGS. 18 and 19, translation of handle 166 from the engaged position to the release position translates latch pin 110 out of engagement with opening 176 of latch plate 151, thereby allowing roller 50 to translate within channel 62.

Spring 112 of latch assembly 109 bears between latch bracket 162 and a collar 190 that is secured to the proximal or inner end of latch pin 110, and which is slidably received within a slot 191 defined in a medial portion of latch bracket 162 that extends parallel to the inner end of latch pin 110. The end of cable 182 opposite actuator handle assembly 160 includes a fitting 192 that is connected by a retainer 195 to collar 190 and is slidable relative to latch bracket 162 via a sleeve 197 that is secured to latch bracket 162, and through which the end of cable 182 extends. Spring 112 biases latch pin 110 outwardly toward opening 176 of latch plate 151. With this construction, latch pin 110 is normally maintained in an extended position by operation of spring 112. As roller 50 is moved within channel 62 toward upper end 154 when the configuration of furniture assembly 10 is being changed from the seating configuration to the bed configuration, the end 170 of latch pin 110 engages ramped guide portion 174 of latch plate 151 as roller 50 approaches upper end 154, to move latch pin 110 inwardly against the biasing force of spring 112. When seat portion 12 and back portion 14 are oriented in the bed configuration, roller 50 is positioned in upper end 154 such that the end 170 of latch pin 110 is aligned with opening 176 of latch plate 151 and the biasing force applied by spring 112 functions to move end 170 of latch pin 110 into opening 176, thereby securing the position of roller 50 within channel 62. Such outward movement of latch pin 110 into opening 176 under the influence of spring 112 provides an audible sound so that the user can know with certainty that back portion 14 has reached its fully upright position.

When it is desired to move seat portion 12 and back portion 14 from the bed configuration to the seating configuration, the user pivots handle 166 from the engaged position to the release position, which tensions cable 182 and translates collar 190 and latch pin 110 inwardly relative to latch bracket 162, thereby compressing spring 112. Once latch pin 110 is translated inwardly and exits opening 176 of latch plate 151, roller 50 is free to translate within channel 62 so that seat portion 12 and back portion 14 can be moved to the seating configuration.

With the construction of furniture assembly 10 as shown and described, a user is able to quickly and easily alter the configuration of the furniture assembly 10 from the seating configuration shown in FIG. 1 to the bed configuration shown in FIG. 2, and vice versa. Latch assembly 109 positively and automatically maintains furniture assembly 10 in the bed configuration when furniture assembly 10 is converted from the seating configuration to the bed configuration, and is easily accessible and operable when it is desired to alter furniture assembly 10 from the bed configuration to the seating configuration.

The invention thus provides a seating furniture assembly that includes a seat member and a back member. The back member is movable relative to the seat member, and has a back surface. The back member is movable between an upwardly extending seating position and a generally horizontal sleeping or bed position. The furniture assembly includes a pivot and roller arrangement that allows translation and rotation between the seat member and the back member. The back surface of the back member is faces upwardly and is generally parallel to a floor when the back member is in the sleeping or bed position.

The invention also provides a furniture assembly that has a first end portion and a second end portion. A seat portion and a back portion are connected between the first end portion and the second end portion. The seat portion and the back portion can be configured in a seating orientation in which the back portion extends upwardly from the seat portion, and a prone orientation in which the back portion is generally parallel to the seat portion. Movement of the back portion from the seating orientation to the prone orientation translates the seat portion relative to the back portion.

The invention also includes a method of converting furniture between a seat configuration and a bed configuration. The method includes the steps of providing an article of furniture having a seat back and a seat member in a seating configuration, and rotating the seat back toward the seat member to expose a rear area of the seat back to form an upwardly facing bed surface. The method may also include translating the seat member forwardly as the seat back is rotated toward the seat member, to a support position in which the seat member supports a forward area of the seat back The present invention has been described in terms of the preferred embodiment, and it is recognized that equivalents, alternatives, and modifications, aside from those expressly stated, are possible and within the scope of the appending claims.

What is claimed is:

1. A seating furniture assembly comprising:

a pair of end members;

a seat member;

a back member having a front surface and a back surface;

a pair of mounting members, wherein the seat member and the back member are connected between the pair of mounting members, and wherein the mounting members are configured to pivotably interconnect the back member with the seat member; and a guide arrangement interposed between the end members and the mounting members to guide movement of the back member relative to the seat member between a first position and a second position, wherein the back member in the first position extends upwardly from the seat member to define a seating configuration in which the front surface of the back member faces forwardly, and wherein movement of the back member to the second position is operable to position the back member such that the back member overlies the seat member and the back surface of the back member faces upwardly;

wherein the guide arrangement includes first and second spaced apart followers carried by each of the mounting members, wherein each first follower is engaged within back member guide channel structure associated with one of the end members, wherein the back member guide channel structure extends in an upward-downward direction and is configured to guide movement of the back member along a first path between the first and second positions, and wherein each second follower is engaged within seat member guide channel structure associated with one of the end members, wherein the seat member guide channel structure extends in a lateral direction and is configured to guide movement of the seat member along a second path different from the first path in response to movement of the back member between the first and second positions, wherein each mounting member translates in an upward-downward direction and in a lateral direction relative to one of the end members by simultaneous movement of the first follower within the back member guide channel structure and movement of the second follower within the seat member guide channel structure to guide movement of the back member and the seat member, respectively, during movement of the back member relative to the seat member between the first and second positions.

2. The seating furniture assembly of claim 1 wherein the back member guide channel structure defines a pair of opposed ends, wherein movement of the first follower toward a first end of the back member guide channel structure is operable to position the back member in the first position and movement of the first follower toward a second end of the back member guide channel structure is operable to position the back member in the second position.

3. The seating furniture assembly of claim 1 wherein the seat member guide channel structure is configured to provide movement of the seat member to a support position in which the seat member engages and supports the back member when the back member is in the second position.

4. A convertible furniture assembly comprising:

a first end portion and a second end portion;

a seat portion connected between the first end portion and the second end portion;

a movable back portion connected between the first end portion and the second end portion and having a seating orientation in which the back portion extends upwardly from the seat portion between the end portions, and a prone orientation in which the back portion overlies the seat portion and faces upwardly between the end portions, wherein the back portion defines a back surface that faces rearwardly when the back portion is in the seating orientation, and wherein the back surface of the back portion faces upwardly when the back portion is in the prone orientation;

a laterally extending seat portion guide arrangement and an upwardly extending back portion guide arrangement interposed between the end portions and the seat and back portions, respectively, for guiding movement of the seat portion and back portion relative to the end portions as the back portion is moved between the seating orientation and the prone orientation, wherein the seat portion and back portion guide arrangements include channel structure associated with the end portions, and one or more seat portion followers and one or more back portion followers engaged within the channel structure;

wherein the seat portion and back portion guide arrangements include separate seat portion and back portion guide channel structure associated with the end portions, and one or more seat portion followers and one or more back portion followers engaged within the seat portion guide channel structure and the back portion guide channel structure, respectively, wherein the back portion guide channel structure is configured to guide upward movement of the back portion along a first path between the seating and prone orientations, and wherein the seat portion guide channel structure is configured to guide lateral movement of the seat portion along a second path different from the first path in response to movement of the back portion between the first and second positions; and a latch arrangement interposed between the back portion and one of the end portions for selectively maintaining the back portion in the bed configuration, wherein the latch arrangement includes a latch actuator and at least one latch member carried by the back portion, wherein the latch member extends through one of the back portion followers and is movable between a latching position, in which the latch member is engaged with one of the end members to prevent movement of the back portion, and a release position in which the latch member is positioned out of engagement with the end members to allow movement of the back portion, and wherein the latch member moves within the back portion guide channel structure along with the back portion follower when the back portion is moved between the seating orientation and the prone orientation.

5. The furniture assembly of claim 4 wherein the back portion includes a back mounting arrangement and the seat portion includes a seat mounting arrangement, wherein the back mounting arrangement and the seat mounting arrangement are pivotably interconnected together for controlling movement of the seat portion as the back portion is moved between the seating orientation and the prone orientation.

6. The furniture assembly of claim 4 wherein at least one of the seat portion followers comprises a guide roller engaged within the seat portion guide channel structure, and wherein the seat portion and the back portion are pivotably interconnected for movement about a pivot axis coincident with an axis of rotation of the guide roller.

7. The furniture assembly of claim 4 wherein at least one of the back portion followers comprises a guide roller engaged within the back portion guide channel structure, wherein the guide roller is movable between first and second ends defined by the back portion guide channel structure, wherein movement of the guide roller toward the first end of the back portion guide channel structure moves the back portion toward the seating orientation and movement of the guide roller toward the second end of the guide channel structure moves the back portion toward the prone orientation, and wherein the guide roller is rotatable about an axis of rotation defined by the latch member.

8. The furniture assembly of claim 4 wherein the latch actuator is carried by the back portion.

9. A method of converting an article of seating furniture between a seat configuration and a bed configuration comprising the steps of:

providing an article of furniture having a back member and a seat member movably mounted between a pair of end members, wherein the back member defines a lower end, and upper end, and first and second oppositely facing support surfaces, wherein the back member extends upwardly from the seat member when the article of seating furniture is in the seat configuration, wherein, when the back member extends upwardly from the seat member when the article of furniture is in the seat configuration, the first support surface of the back member faces in a forward direction and the second support surface of the back member faces in a rearward direction, and the lower end of the back member is located below an upper surface defined by the seat member and the upper end of the back member is located above the upper surface of the seat member;

moving the back member toward and over the seat member to place the article of seating furniture in the bed configuration, wherein, when the article of seating furniture is in the bed configuration, the back member overlies the seat member and is position such that the first support surface of the back member faces downwardly and the second support surface of the back member faces upwardly to form an upwardly facing bed surface, and translating the seat member in the forward direction as the back member is moved toward and over the seat member when the article of furniture is moved from the seat configuration to the bed configuration, wherein movement of the seat member in the forward direction during movement of the back member toward and over the seat member is operable to move the lower end of the back member forwardly to provide wall clearance for the lower end of the back member during movement of the back member toward and over the seat member.

10. The method of claim 9 wherein the steps of moving the back member and translating the seat member are carried out by movement of guide members associated with the back member and the seat member within channel structure defined by one or more end members associated with the article of furniture.

11. The method of claim 9 further comprising the step of releasably maintaining the back member in engagement with at least one of the end members to maintain the article of seating furniture in the bed orientation in which the back member overlies the seat member.

12. The method of claim 11 wherein the step of releasably maintaining the back member in engagement with the end member is carried out by operation of a biased latching arrangement that functions to fix the position of the back member relative to the seat member when the back member is positioned so as to overlie the seat member.

* * * * *

UNITED STATES PATENT AND TRADEMARK OFFICE

CERTIFICATE OF CORRECTION

PATENT NO. : 7,607,180 B2
APPLICATION NO. : 11/674779
DATED : October 27, 2009
INVENTOR(S) : Dennis G. Griepentrog It is certified that error appears in the above-identified patent and that said Letters Patent is hereby corrected as shown below:

In column 14, claim 9, line 8, change "position" to --positioned--.

Signed and Sealed this

Twenty-second Day of December, 2009

David J. Kappos

David J. Kappos
*Director of the United States Patent and Trademark Office*